US010655506B2

(12) United States Patent
Tsunoda

(10) Patent No.: US 10,655,506 B2
(45) Date of Patent: May 19, 2020

(54) CAMSHAFT AND MANUFACTURING METHOD THEREFOR

(71) Applicant: ISUZU MOTORS LIMITED, Shinagawa-ku, Tokyo (JP)

(72) Inventor: Hiroshi Tsunoda, Chigasaki (JP)

(73) Assignee: ISUZU MOTORS LIMITED, Shinagawa-Ku, Tokyo (JP)

( * ) Notice: Subject to any disclaimer, the term of this patent is extended or adjusted under 35 U.S.C. 154(b) by 0 days.

(21) Appl. No.: 16/072,859

(22) PCT Filed: Jan. 19, 2017

(86) PCT No.: PCT/JP2017/001682
§ 371 (c)(1),
(2) Date: Jul. 25, 2018

(87) PCT Pub. No.: WO2017/130826
PCT Pub. Date: Aug. 3, 2017

(65) Prior Publication Data

US 2018/0371960 A1 Dec. 27, 2018

(30) Foreign Application Priority Data

Jan. 28, 2016 (JP) ..... 2016-014405

(51) Int. Cl.
*F01L 1/04* (2006.01)
*F01L 1/053* (2006.01)
(Continued)

(52) U.S. Cl.
CPC ..... *F01L 1/0532* (2013.01); *F01L 1/053* (2013.01); *F01L 13/0021* (2013.01);
(Continued)

(58) Field of Classification Search
CPC ..... F01L 13/0036; F01L 2013/0052; F01L 1/0532; F01L 2001/0473; F01L 2013/0078
(Continued)

(56) References Cited

U.S. PATENT DOCUMENTS 5,664,463 A 9/1997 Amborn et al.
9,027,520 B2 * 5/2015 Gunnel ..... F01L 1/344 123/90.16
(Continued)

FOREIGN PATENT DOCUMENTS

CN 102112706 A 6/2011
DE 10 2004 022 849 A1 12/2005
(Continued)

OTHER PUBLICATIONS

Extended European Search Report for corresponding EP Patent Application No. 17744056.7, dated Jan. 28, 2019, in 11 pages.
(Continued)

*Primary Examiner* — Ching Chang
(74) *Attorney, Agent, or Firm* — Procopio, Cory, Hargreaves & Savitch LLP

(57) ABSTRACT

Multiple tubular members 40 that include multiple cam members 41 and 42 having cam parts 11 are connected to each other to form a single cam tube 12. Multiple female splines 45, which are partially arranged on an inner tube surface 44 of the tubular members which include the cam members 41 and 42, mate with male splines 47 formed on the outer tube surface 46 of a drive shaft 13, and the cam tube 12 rotates integrally with the drive shaft 13, and is capable of moving freely in the axial direction thereof.

7 Claims, 11 Drawing Sheets

(51) Int. Cl.

| | |
|---|---|
| ***F01L 13/00*** | (2006.01) |
| *F01L 1/08* | (2006.01) |
| *F01L 1/047* | (2006.01) |
| *F01L 1/18* | (2006.01) |

(52) U.S. Cl.
CPC ..... *F01L 13/0036* (2013.01); *F01L 1/08* (2013.01); *F01L 1/185* (2013.01); *F01L 2001/0471* (2013.01); *F01L 2001/0473* (2013.01); *F01L 2013/0052* (2013.01); *F01L 2013/0078* (2013.01); *F01L 2103/00* (2013.01)

(58) Field of Classification Search
USPC ..... 123/90.16, 90.18, 90.6
See application file for complete search history.

(56) References Cited

U.S. PATENT DOCUMENTS

| | | | |
|---|---|---|---|
| 2011/0185995 | A1 | 8/2011 | Deblaize et al. |
| 2014/0076256 | A1 | 3/2014 | Gunnel et al. |
| 2015/0059677 | A1 | 3/2015 | Doller |
| 2018/0030863 | A1 | 2/2018 | Junge et al. |

FOREIGN PATENT DOCUMENTS

| | | | |
|---|---|---|---|
| DE | 10 2005 020 236 | A1 | 11/2006 |
| DE | 102007057811 | A1 | 6/2009 |
| DE | 10 2011 121 684 | A1 | 6/2013 |
| JP | S54-171008 | U1 | 3/1979 |
| JP | S61-186704 | U1 | 11/1986 |
| JP | H07-332045 | A | 12/1995 |
| JP | 2013-253485 | A | 12/2013 |
| JP | 2014-227863 | A | 12/2014 |
| JP | 2015-514914 | A | 5/2015 |
| JP | 2015-232300 | A | 12/2015 |
| WO | 2012/152455 | A1 | 11/2012 |
| WO | 2016/119934 | A1 | 8/2016 |

OTHER PUBLICATIONS

International Search Report and Written Opinion for related International Application No. PCT/JP2017/001682 dated Feb. 21, 2017; English translation for ISR provided; 9 pages.
Notice of Reasons for Refusal for related JP App. No. JP-OA 2016-014405 dated Dec. 3, 2019, 6 pages.
First Office Action for corresponding CN App No. CN-OA 201780007890.0, dated Nov. 26, 2019, 13 pages.
EP Communication for EP App No. 17744056.7, dated Jan. 21, 2020; 40 pages.

* cited by examiner

[ FIG. 1 ]
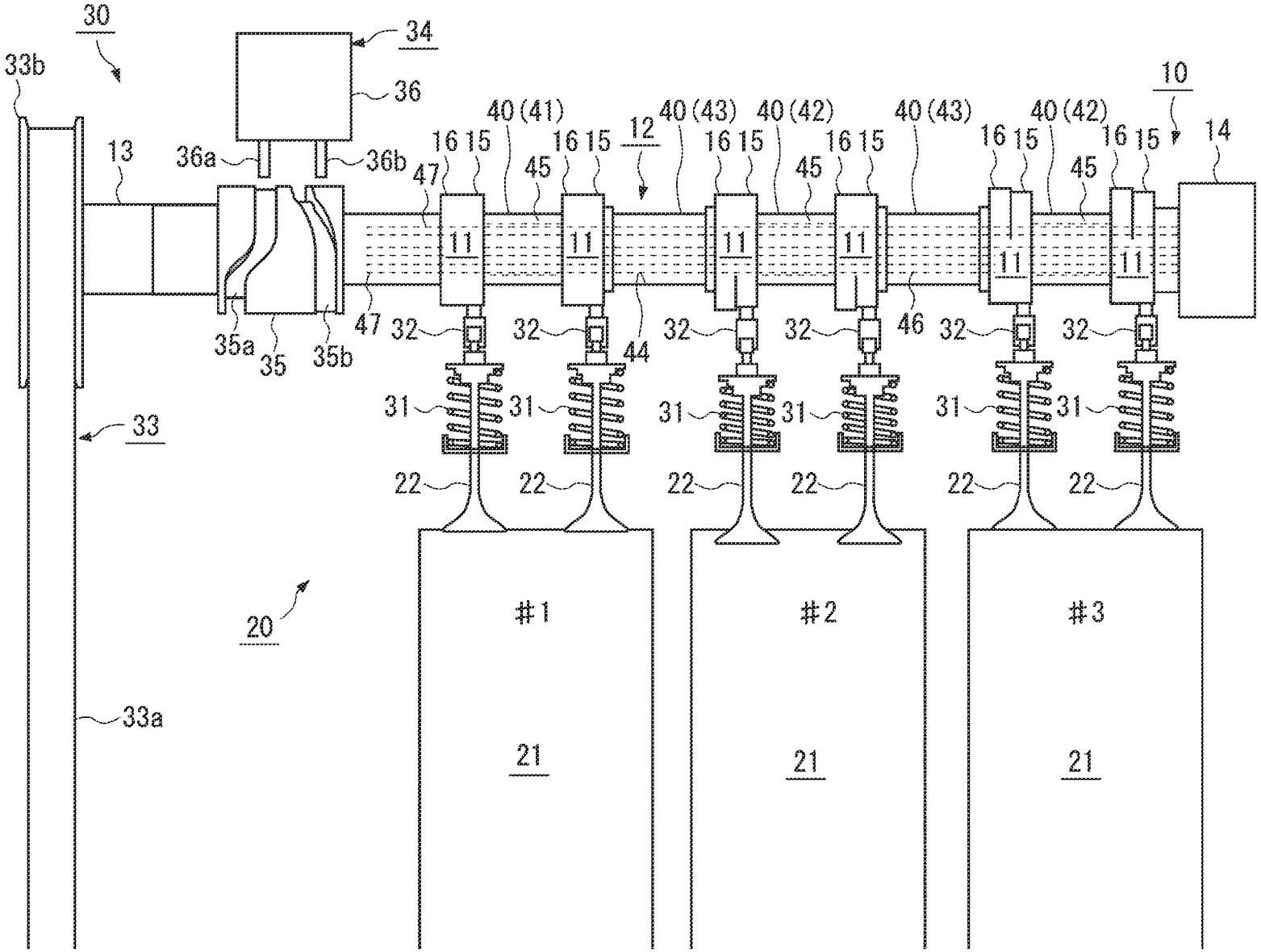

[ FIG. 2A ]
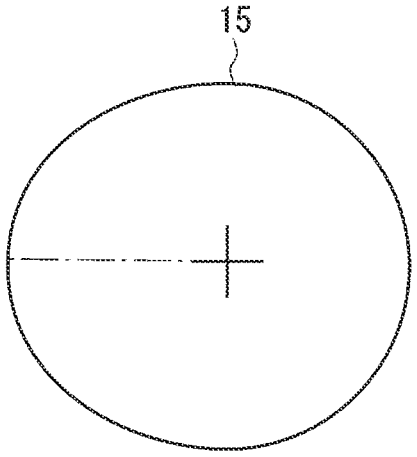
[ FIG. 2B ]
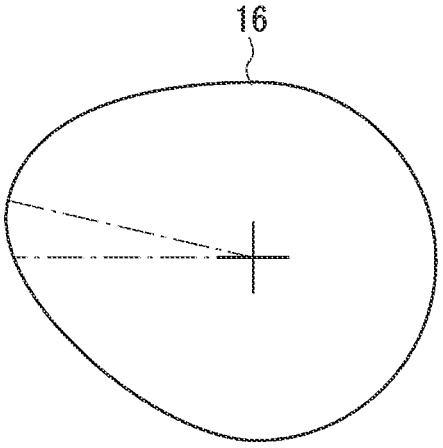

[ FIG. 3A ]
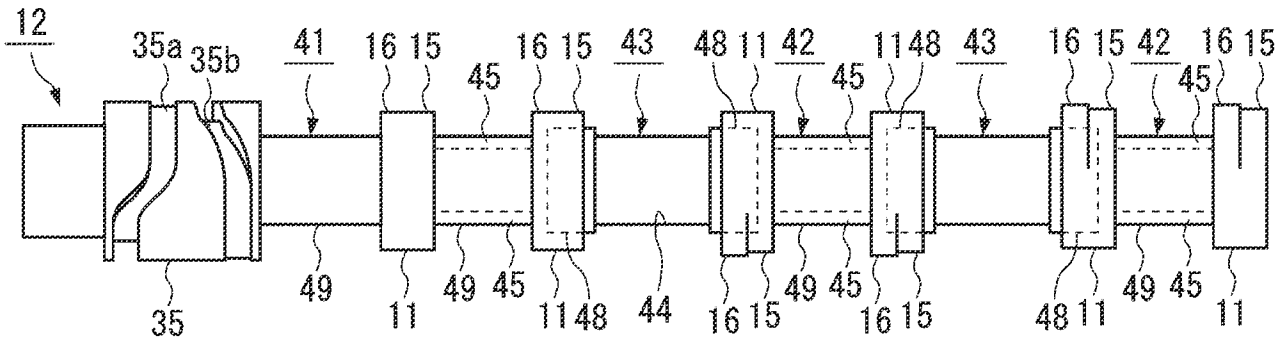

[ FIG. 3B ]
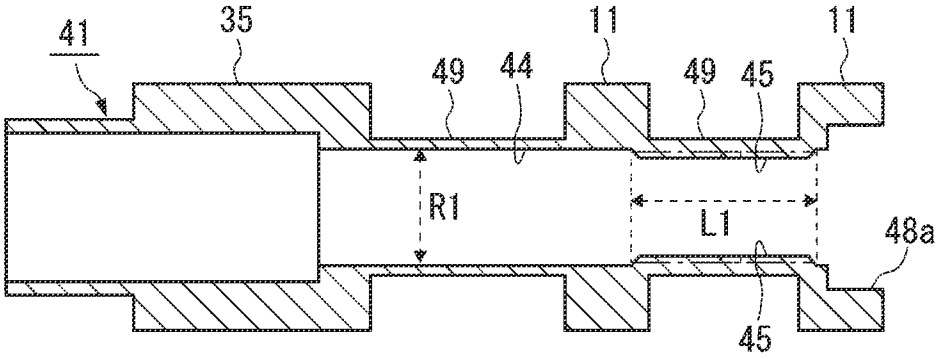
[ FIG. 3C ]
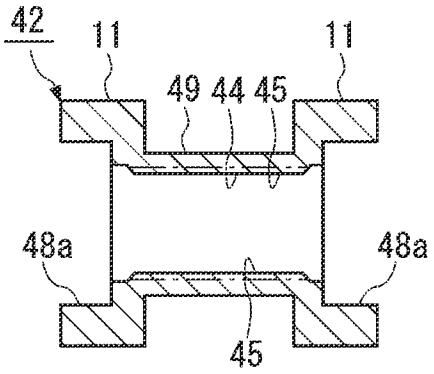

[ FIG. 3D ]
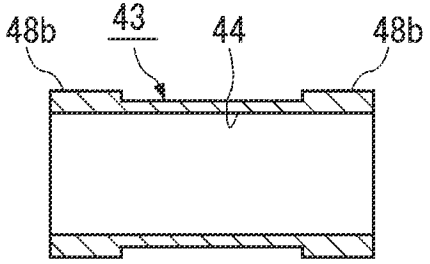

[ FIG. 4A ]
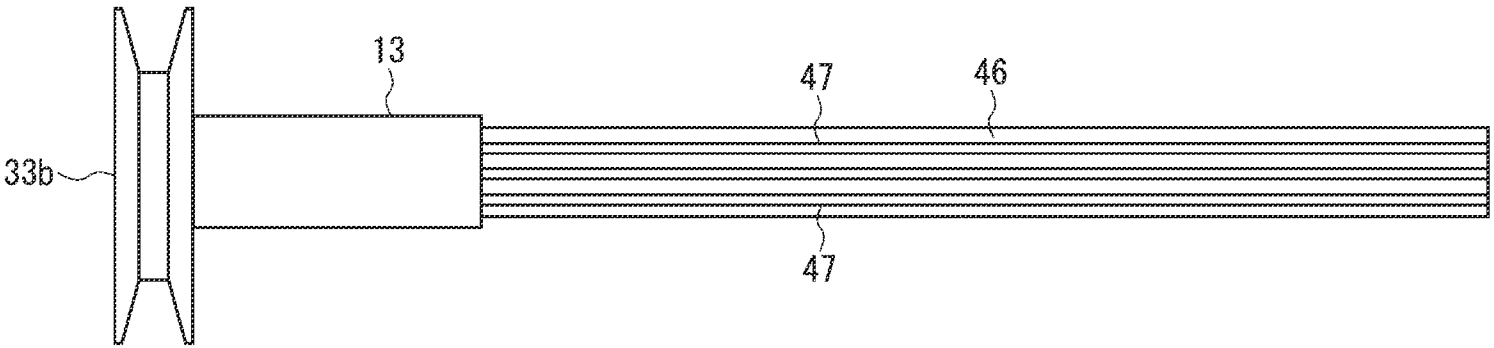

[ FIG. 4B ]
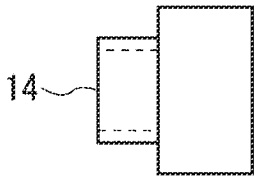

[ FIG. 5 ]
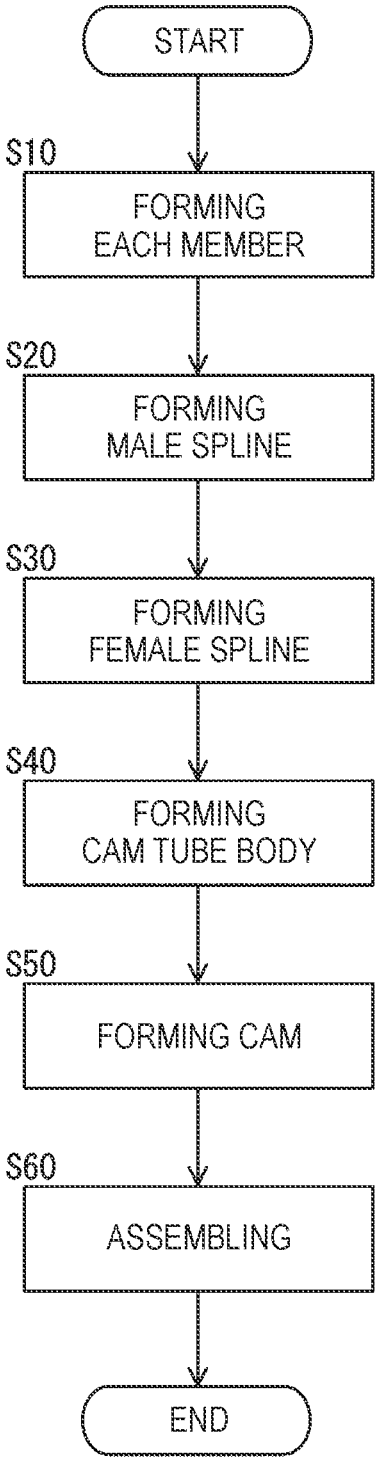

[ FIG. 6 ]
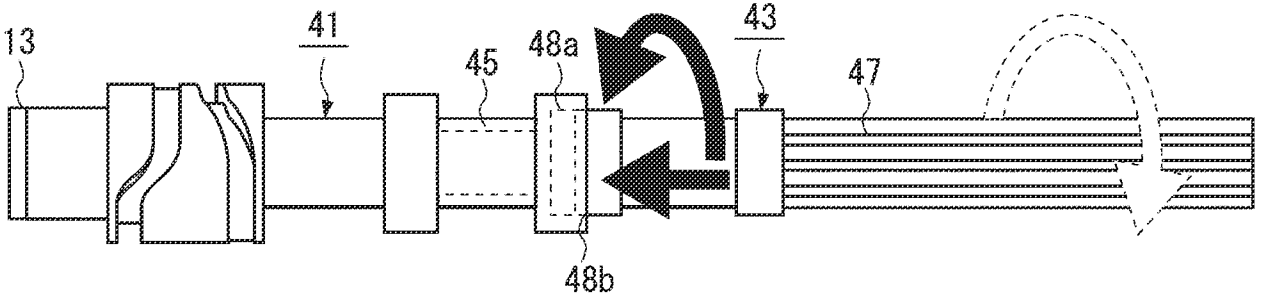

[ FIG. 7A ]
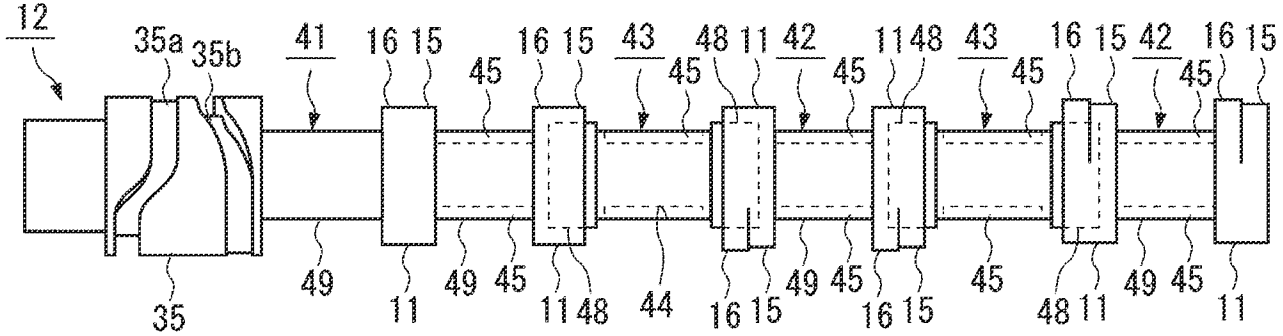

[ FIG. 7B ]
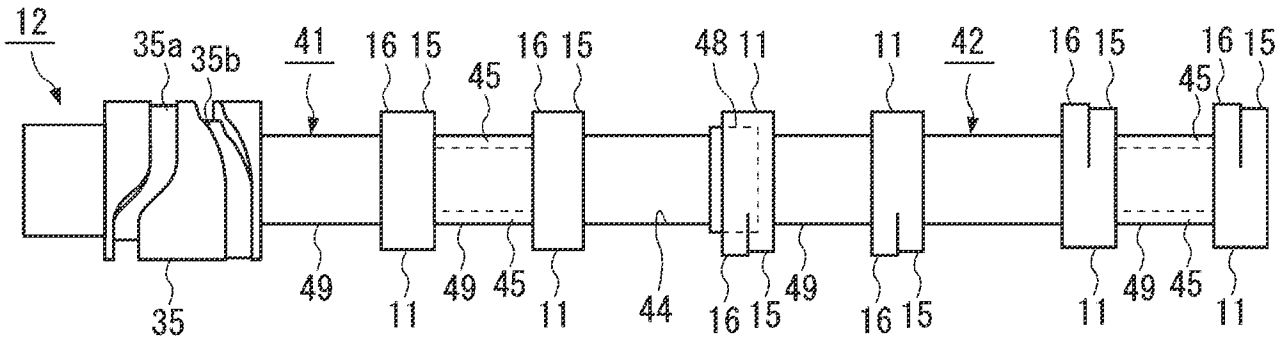

CAMSHAFT AND MANUFACTURING METHOD THEREFOR

CROSS-REFERENCE TO RELATED APPLICATIONS

This application is a U.S. National Stage entry of PCT Application No: PCT/JP2017/001682 filed on Jan. 19, 2017, which claims priority to Japanese Patent Application No. 2016-014405, filed on Jan. 28, 2016, the contents of which are incorporated herein by reference.

TECHNICAL FIELD

The present disclosure relates to a camshaft and a manufacturing method therefor, and more particularly, to a camshaft which opens and closes an intake or exhaust valve of an engine including three or more cylinders in series while switching a cam profile when opening and closing the intake or exhaust valve, and a manufacturing method therefor.

BACKGROUND ART

As a valve mechanism for opening and closing an intake or exhaust valve of an engine, there has been proposed a camshaft including a tubular cam tube including one or more cam parts, and a driving shaft inserted into the cam tube (for example, see PTL 1).

In the valve mechanism, the driving shaft which transmits rotary power transmitted from a power transmission device rotates, and the cam tube integrally rotates with the driving shaft via spline fitting, so that the intake or exhaust valve is opened and closed. A switching device is configured to move the cam tube in an axial direction of the driving shaft, so as to switch a plurality of cam profiles provided on the cam part with respect to one intake or exhaust valve.

A male spline formed on an outer tubular surface of the driving shaft can be machined by cutting machining or rolling machining regardless of a spline groove length. A female spline formed on an inner tubular surface of the cam tube can be machined by broaching machining or electric discharge machining.

However, in the broaching machining, since a cutting tool enters into an inner diameter, a cutting load during the machining is received by a thin shaft, and therefore, the spline groove length is limited to one to two times of a spline nominal diameter. Also, only one female spline can be formed in one cam tube. That is, although there is no problem for a cam tube extending over one or two cylinders, for a cam tube extending over three or more cylinders, a female spline groove length becomes short.

In this case, for the cam tube extending over three or more cylinders, when the female spline groove length is shortened, a driving torque for opening and closing the intake or exhaust valve cannot be transmitted sufficiently via the spline fitting from the driving shaft.

On the other hand, even if the intake or exhaust valve can be opened and closed with a small driving torque by reducing a biasing force of a valve spring of the intake or exhaust valve, as the biasing force of the valve spring decreases, the intake or exhaust valve may be stuck or opened due to exhaust pressure, and reliability of the engine may be impaired.

Therefore, in the cam tube extending over three or more cylinders, countermeasures are taken such as increasing the spline nominal diameter, or providing a plurality of cam tubes for one camshaft.

However, when the spline nominal diameter is increased to secure a sufficient spline groove length, a diameter of the cam tube is increased and the camshaft becomes heavy and large, so that mountability of the camshaft to the engine deteriorates. Further, when a long cam tube only includes one female spline, depending on a position where the female spline is arranged, the cam tube may be inclined when the cam tube is moved in the axial direction of the driving shaft. Further, when a plurality of cam tubes are provided for one camshaft, switching devices for switching the cam profiles is required by a number of division, and the valve mechanism becomes heavy and large, so that mountability of the valve mechanism to the engine deteriorates.

On the other hand, in the electric discharge machining, it is difficult to ensure machining accuracy when the spline groove length is long. Also, a device for performing the electric discharge machining becomes large in scale, manufacturing cost is significantly increased, and mass production becomes difficult.

CITATION LIST

Patent Literature

PTL 1: JP-A-2014-227863

SUMMARY OF INVENTION

Technical Problem

An object of the disclosure is to provide a camshaft in which an intake or exhaust valve of an engine including three or more cylinders in series is opened and closed while switching a cam profile, a driving torque can be sufficiently ensured to open and close the intake or exhaust valve, and mountability thereof is increased. Also, an object of the disclosure is to provide a method for manufacturing a camshaft in which manufacturing cost of the camshaft can be kept low and mass productivity can be improved.

Solution to Problem

A camshaft of the present disclosure for achieving the above object is a camshaft extending over three or more cylinders arranged in series in an engine, the camshaft including: a plurality of cam parts each having a plurality of cam profiles having different shapes from each other with respect to one intake or exhaust valve; one tubular cam tube on which the plurality of cam parts is arranged to be spaced apart from each other in an axial direction; and one driving shaft inserted into the cam tube, wherein the cam tube is configured by connecting a plurality of tubular members which includes a tubular cam member including the cam part to each other; wherein a female spline is arranged on an inner tubular surface of at least each tubular member which includes the cam member among the plurality of tubular members, and a plurality of the female splines are partially arranged in the axial direction of the cam tube on an inner tubular surface of the cam tube; wherein a male spline is arranged on an outer tubular surface of the driving shaft; and wherein, in a state where the driving shaft is inserted into the cam tube, the plurality of female splines and the male spline are fitted to each other, so that the cam tube is configured to rotate integrally with the driving shaft and be movable in the axial direction thereof.

Further, a manufacturing method for achieving the above object is a method for manufacturing a camshaft extending over three or more cylinders arranged in series in an engine, the method including: a step of separately forming a driving shaft and a plurality of tubular members which includes a tubular cam member including a cam part and forms a cam tube when being integrated; a step of forming a male spline on an outer tubular surface of the driving shaft; a step of forming a female spline by performing broaching machining on an inner tubular surface of at least each tubular member which includes the cam member among the plurality of tubular members; and a step of connecting and integrating all of the plurality of tubular members to form the cam tube, wherein the step of forming the cam tube is a step in which, in a state where the driving shaft is inserted into adjacent tubular members, end potions of the adjacent tubular members are integrated with each other by press-fitting while fitting the male spline with the female spline.

Advantageous Effects of Invention

According to the camshaft and the manufacturing method therefor, in the camshaft extending over three or more cylinders, the cam tube is configured by a plurality of divided tubular members, and therefore, a length of each tubular member in an axial direction can be shortened, so that a female spline can be formed by broaching machining on an inner tubular surface of at least each tubular member which includes the cam member among the plurality of tubular members. Therefore, a plurality of female splines can be partially formed in the axial direction on the cam tube which is formed by integrating end portions of the tubular members with each other by press-fitting.

That is, in a state where the driving shaft is inserted into the cam tube, the plurality of female splines formed in the cam tube and the male spline formed on the driving shaft are fitted to each other. Accordingly, a driving torque for opening and closing the intake or exhaust valve can be sufficiently transmitted from the driving shaft.

According to the camshaft and the manufacturing method therefor, the camshaft can sufficiently transmit the driving torque for opening and closing the intake or exhaust valve without reducing a biasing force of a valve spring of the intake or exhaust valve. In addition, it is also not necessary to increase a spline nominal diameter or to provide a plurality of cam tubes for one camshaft.

Therefore, since it becomes possible to open and close the intake or exhaust valve accurately at a predetermined timing, while ensuring reliability of an engine, the cam tube or a valve mechanism incorporating the camshaft is prevented from becoming heavy and huge so that mountability thereof can be improved. Further, since the female spline is formed by broaching machining, a large-scale device is not necessary as in the electric discharge machining. Therefore, manufacturing cost can be kept low and mass productivity is improved.

BRIEF DESCRIPTION OF DRAWINGS

FIG. 1 is a configuration diagram illustrating a camshaft according to an embodiment of the present disclosure.

FIG. 2A is a side view illustrating a cam profile of a cam part of FIG. 1.

FIG. 2B is a side view illustrating another cam profile of the cam part of FIG. 1.

FIG. 3A is a detailed view of a cam tube of FIG. 1 and illustrates a configuration diagram of the cam tube.

FIG. 3B is a detailed view of the cam tube of FIG. 1 and illustrates a cross-sectional view of a cam member.

FIG. 3C is a detailed view of the cam tube of FIG. 1 and illustrates a cross-sectional view of the cam member.

FIG. 3D is a detailed view of the cam tube of FIG. 1 and illustrates a cross-sectional view of a journal member.

FIG. 4A is a configuration diagram illustrating a driving shaft of FIG. 1.

FIG. 4B is a configuration diagram illustrating a rear end.

FIG. 5 is a flow diagram illustrating a method for manufacturing the camshaft according to an embodiment of the present disclosure.

FIG. 6 is an illustrative diagram explaining steps of forming the cam tube of FIG. 5 in detail.

FIG. 7A is a configuration diagram showing an example of a camshaft having a configuration different from FIG. 1.

FIG. 7B is a configuration diagram showing another example of a camshaft having a configuration different from FIG. 1.

DESCRIPTION OF EMBODIMENTS

Hereinafter, embodiments of the present invention are described with reference to the drawings. FIG. 1 illustrates a camshaft 10 according to an embodiment of the present invention. The camshaft 10 is a rotatable shaft body which extends over three or more cylinders 21 arranged in series in an engine 20, and includes a plurality of cam parts 11, a cam tube 12, and a driving shaft 13. The camshaft 10 is incorporated in a valve mechanism 30, and opens and closes intake or exhaust valves 22 of the cylinders 21 by rotating. FIG. 1 shows a case with three cylinders 21, in which #1 indicates a first cylinder, #2 indicates a second cylinder, and #3 indicates a third cylinder of the engine 20.

The engine 20 includes three cylinders 21, and four intake or exhaust valves 22 in total, in which two intake valves 22 and tow exhaust valves 22 are arranged for one cylinder 21. The valve mechanism 30 which opens and closes the valves 22 includes the camshaft 10, a valve spring 31, a rocker arm 32, a power transmission device 33, and a switching device 34.

The camshaft 10 includes a plurality of cam parts 11, a cam tube 12, a driving shaft 13, and a rear end 14. The cam part 11 includes a plurality of cam profiles 15, 16 having different shapes from each other with respect to one valve 22. The cam tube 12 is formed into a one tube shape, and the plurality of cam parts 11 protruding outward from an outer tubular surface of the cam tube 12 are arranged to be spaced apart from each other in an axial direction. The driving shaft 13 is inserted into the cam tube 12, and an end portion thereof is fixed by the rear end 14 so that the driving shaft 13 does not come off the cam tube 12.

The valve spring 31 is an elastic body which comes into contact with one end of the valve 22 and biases the valve 22 to a close state. The rocker arm 32 is configured to be freely swingable so as to resist a biasing force of the valve spring 31 and keep the valve 22 in an open state. The power transmission device 33 includes a pulley fixed to a crankshaft (not shown), an endless belt 33*a*, and a pulley 33*b* fixed to the camshaft 10. The switching device 34 includes a groove part 35 fixed to the camshaft 10 and an actuator 36. The groove part 35 includes a first groove 35*a* and a second groove 35*b*, and the actuator 36 includes a first switching pin 36*a* and a second switching pin 36*b*.

In the valve mechanism 30, the driving shaft 13 of the camshaft 10 is rotated by a rotary power transmitted via the power transmission device 33. The rotary power is transmitted from the driving shaft 13 to the cam tube 12 via spline fitting, and the cam tube 12 rotates integrally with the driving shaft 13. As the cam tube 12 rotates, the cam part 11 having an egg-shaped cross section rotates, so that the rocker arm 32 operates based on "principle of leverage" to open and close the valve 22.

In addition, in the valve mechanism 30, when the first switching pin 36*a* of the switching device 34 is inserted into the first groove 35*a*, the cam tube 12 moves horizontally due to drag from the first cylinder #1 to the third cylinder #3 in an axial direction of the driving shaft 13. At this time, a portion of the cam part 11 which presses the rocker arm 32 is switched from a first cam profile 15 to a second cam profile 16. On the other hand, when the second switching pin 36*b* is inserted into the second groove 35*b*, the cam tube 12 moves horizontally due to drag from the third cylinder #3 to the first cylinder # in the axial direction of the driving shaft 13. At this time, the portion of the cam part 11 which presses the rocker arm 32 is switched from the second cam profile 16 to the first cam profile 15.

In this embodiment, an straight-three engine including three cylinders 21 arranged in series is illustrated, but in an engine in which three or more cylinders 21 are arranged in series, a horizontally opposed type, a V type, a W type or the like may also be used. Also, the intake or exhaust valves 22 may be arranged as one intake valve and one exhaust valve for each cylinder. Also, the valve mechanism 30 is illustrated as a twin type cam mechanism (DOHC) which opens and closes an intake valve 22 and an exhaust valve 22 with separate camshafts 10, but may also be a single type cam mechanism (SOHC) which opens and closes the intake or exhaust valve 22 with one camshaft.

In the camshaft 10 extending over three or more cylinders 21, the cam tube 12 is formed into the one tube shape by connecting a plurality of tubular members 40 whose both ends are opened to each other. Among the plurality of tubular members 40, some of the tubular members 40 are cam members 41, 42 including a cam part 11, while the remaining tubular members 40 are journal members 43 without a cam part 11. Each of the cam members 41, 42 has a female spline 45 provided on an inner tubular surface 44 thereof. Also, the driving shaft 13 has a male spline 47 on an outer tubular surface 46 thereof. In a state where the driving shaft 13 is inserted into the cam tube 12, a plurality of female splines 45 partially arranged on the inner tubular surface 44 of the cam members 41, 42 of the cam tube 12 and the male spline 47 are fitted to each other, so that the cam tube 12 is configured to rotate integrally with the driving shaft 13 and be movable in an axial direction thereof.

FIGS. 2A to 4B illustrate the configuration of the camshaft 10 in detail. FIGS. 2A and 2B illustrate the cam profiles 15, 16 of the cam part 11, respectively. FIG. 3A illustrates the cam tube 12, and FIGS. 3B to 3D illustrate the tubular members 40 configuring the cam tube 12. Specifically, FIG. 3B illustrates the cam member 41, FIG. 3C illustrates the cam member 42, and FIG. 3D illustrates the journal member 43. FIG. 4A illustrates the driving shaft 13, and FIG. 4B illustrates the rear end 14.

As shown in FIGS. 2A and 2B, the cam part 11 is a disc having an egg-shaped cross section and is in contact with the rocker arm 32. The cam profiles 15, 16 of the cam part 11 are formed into different shapes from each other.

Accordingly, an opening and closing time can be changed in the intake valve 22, so that more intake air can be transmitted into the cylinder 21 when the engine 20 is operating in high load condition. In addition, the exhaust valve 22 can be opened earlier, so that a temperature of exhaust gas discharged from the cylinder 21 can be raised, catalyst of an exhaust gas purification device can be warmed up, or the exhaust gas can be regenerated.

For example, in the intake valve 22, the first cam profile 15 is adopted in a case where the engine 20 is operating in low load condition, and the second cam profile 16 is adopted in a case where the engine 20 is operating in the high load condition. Further, in the exhaust valve 22, the first cam profile 15 is adopted in a normal condition, and the second cam profile 16 is adopted when raising the temperature of the exhaust gas discharged from the cylinder 21.

As shown in FIG. 3, the cam tube 12 is one tube formed by connecting the plurality of tubular members 40 to each other, and a plurality of cam parts 11 are arranged to be spaced apart from each other in the axial direction of the cam tube. The cam tube 12 is configured by the plurality of tubular members 40. Specifically, the cam tube 12 is configured by the cam members 41, 42 which include a cam part 11 and the journal members 43 which do not include a cam part 11 and are connected between the cam members 41, 42, in which adjacent members are connected to each other via a press-fit part 48.

Therefore, the cam tube 12 of the camshaft 10 extending over three or more cylinders 21 is formed into the one tube shape, so that the cam profiles 15, 16 for pressing the rocker arms 32 can be switched by one switching device 34. Accordingly, the valve mechanism 30 can be prevented from becoming heavy and huge, so that mountability of the valve mechanism 30 to the engine 20 is improved.

In the cam tube 12, the female spline 45 is at least provided on the inner tubular surface 44 of each of the cam members 41, 42 among the tubular members 40. That is, the plurality of female splines 45 is partially formed in the axial direction of the cam tube 12 (the axial direction of the driving shaft 13 in a state where the driving shaft 13 is inserted into the cam tube 12) over an entire area of the inner tubular surface 44 of the cam tube 12.

In this way, the plurality of female splines 45 is partially formed on the inner tubular surface 44 of the cam tube 12, so that the rotary power transmitted from the driving shaft 13 can be transmitted by the plurality of female splines 45, and deficiency of rotary power transmission can be solved. Further, the plurality of female splines 45 is formed on the inner tubular surface 44 of each of the cam members 41, 42 which includes a cam part 11, so that phase shifting of the cam part 11 with respect to a rotation phase of the driving shaft 13 can be avoided. Therefore, the intake or exhaust valves 22 can be opened and closed with high precision at an intended timing.

When the female spline 45 is also formed on the journal member 43 (a tubular member without a cam part), the transmission of the rotary driving power becomes more sufficient, but it is not necessary to consider the phase shifting since the journal member 43 does not include a cam part 11. Therefore, by forming the female splines 45 only on the cam members 41, 42, a number of manufacturing steps can be reduced and manufacturing cost can be kept low.

The female spline 45 is described in detail. The female splines 45 are formed at least on a range between the plurality of cam parts 11 of the cam members 41, 42 in the axial direction of the driving shaft 13. The cam members 41, 42 are separated for each cylinder 21, and each of them includes two cam parts 11 corresponding to the intake or exhaust valves 22 of each cylinder 21. In particular, the cam member 42 includes cam parts 11 at both ends thereof. The female spline 45 is formed between two cam parts 11 corresponding to intake or exhaust valves 22 of one of the cylinders 21, so that a groove length L1 of one female spline 45 can be extended to the maximum, and therefore, a fitting length of the spline corresponding to the rotary power can be ensured.

Preferably, at least one female spline 45 is formed with respect to one cylinder 21. Accordingly, phase shifting in the one cylinder 21 can be reliably avoided, so that the intake or exhaust valves 22 can be opened and closed with higher precision at an intended timing.

The cam member 41 is a tubular member 40 arranged on a power transmission device 33 side in the camshaft 10. The cam member 41 includes two cam parts 11 corresponding to intake or exhaust valves 22 of the first cylinder #1, the groove part 35 of the switching device 34, a press-fit recess 48*a* into which the journal member 43 is press-fitted, and a connecting portion 49 that connects them together. The groove part 35 is arranged at a portion which is on the power transmission device 33 side of the cam member 41, and one cam part 11 and the press-fit recess 48*a* are arranged on another end which is the opposite side. As described above, in the cam member 41, the female spline 45 is formed at least on a range of the inner tubular surface 44 between two cam parts 11, that is, at least on a range of the connecting portion 49 which connects the two cam parts 11.

Two cam members 42 are tubular members 40 arranged between the cam member 41 and the rear end 14 in the camshaft 10. The cam member 42 includes two cam parts 11 corresponding to intake or exhaust valves 22 of the second cylinder #2 (or the third cylinder #3) arranged on both ends thereof, press-fit recesses 48*a* similarly arranged on both ends, and a connecting portion 49 that connects the two cam parts 11. In the cam member 42, the female spline 45 is formed on the inner tubular surface 44 including a range between the two cam parts 11.

Compared with the cam members 41, 42, the journal member 43 has no cam part 11 or female spline 45, and includes press-fit projections 48*b* at both ends respectively.

As shown in FIGS. 4A and 4B, the driving shaft 13 is one single shaft which is connected to the pulley 33*b* of the power transmission device 33 in a state of being inserted into the cam tube 12. The driving shaft 13 includes a male spline 47 on an outer tubular surface 46 thereof. The rear end 14 is press-fitted into one end of the cam tube 12.

Hereinafter, a method for manufacturing the camshaft 10 of the embodiment is described with reference to a flow diagram of FIG. 5.

First, the plurality of tubular members 40 which includes the cam members 41, 42 (tubular member with a cam part) and the journal member 43 (tubular member without a cam part) which configures one cam tube 12, one driving shaft 13, and the rear end 14 are separately formed (S10). In this step, in a member to which the female spline 45 is to be formed in the following steps among the tubular members 40, the portion to which the female spline 45 is to be formed is formed to protrude inside the member, that is, only the portion is formed to be thick.

Next, the male spline 47 is formed on an outer tubular surface 46 of the driving shaft 13 (S20). In this step, the male spline 47 is formed by cutting machining or rolling machining. The male spline 47 may be formed at least in a range between cam parts 11 arranged at both ends of the cam tube 12. Similarly to the female spline 45, a plurality of the male splines 47 may also be formed partially on the outer tubular surface 46. However, it is desirable that a state where the male spline and all female splines 45 are fitted to each other can be maintained even when the cam tube 12 is moved in an axial direction by the switching device 34.

Next, the female spline 45 is formed by broaching machining on an inner tubular surface 44 of at least each of the cam members 41, 42 (tubular members with a cam part) among the plurality of tubular members 40 (S30). In the broaching machining, a cutting tool enters into the tubular member 40, and the inner tubular surface 44 is cut by the cutting tool. In the broaching machining, a cutting load of the cutting tool during the machining is received by a thin shaft, so that a groove length L1 of the female spline 45 is limited to one to two times of a spline nominal diameter R1, and only one female spline can be formed in one tube.

The cam tube 12 is divided into the plurality of tubular members 40, and a length of the tubular member 40 can be made into a length capable of being broached. Therefore, since the female spline 45 of the tubular member 40 can be formed by broaching machining, the manufacturing cost can be kept low and mass production can also be performed.

In order to form the female spline 45 by broaching machining, it is necessary to divide the cam tube 12 into the plurality of tubular members 40. In this case, an axial length of the tubular member 40 is preferably made longer than the groove length L1 of the female spline 45.

Next, all tubular members 40 are integrated to each other so as to form the cam tube 12 (a cam tube body which is one tube formed by connecting all tubular members 40 to each other), and the camshaft 10 is formed (S40). In step S40, in a state where the driving shaft 13 is inserted into adjacent tubular members 40, end potions of the tubular members 40 are integrated with each other by press-fitting while fitting the male spline 47 formed on the driving shaft 13 and the female splines 45 formed on the cam members 41, 42.

In a case where the end portions of the adjacent tubular members 40 are integrated, that is, the press-fit projections 48*b* are press-fitted into the press-fit recesses 48*a*, even if the tubular members 40 try to rotate in a circumferential direction separately, the rotation thereof can be suppressed since the male spline 47 and the female spline 45 are fitted to each other, so that rotation shifting at the time of press-fitting can be suppressed. Accordingly, even if the end portions of a plurality of separate tubular members 40 are integrated by press-fitting to form the cam tube 2, the phase shifting caused by the rotation shifting at the time of press-fitting can be avoided.

FIG. 6 illustrates a press-fitting method in the above step S40. A white arrow in the figure indicates a rotation direction of the driving shaft 13 when being rotated as the camshaft 10, and black arrows in the figure indicate directions of load applied to the tubular member 40.

As shown in FIG. 6, in step S40, it is preferable that the driving shaft 13 is fixed and a load in a direction opposite to the rotation direction of the driving shaft 13 when being rotated as the camshaft 10 is applied to the tubular member 40 so as to perform the press-fitting.

By press-fitting the tubular member 40 in such a manner, the press-fitting can be performed while absorbing backlash between the female spline 45 and the male spline 47. Therefore, when being rotated as the camshaft 10, all female splines 45 and the male spline 47 reliably come into contact with each other, so that displacement of the rotation phase can be reliably prevented.

Next, after the cam tube 12 is formed, a plurality of cam profiles 15, 16 having different shapes from each other with respect to one intake or exhaust valve is formed to the cam part 11 (S50).

Therefore, even if certain rotation shifting occurs when all tubular members 40 are integrated by press-fitting, the cam profiles 15, 16 can be formed so as to correct the rotation shifting. Accordingly, a phase with respect to the rotation of the driving shaft 13 is reliably guaranteed, and the intake or exhaust valve 22 can be opened and closed with high precision at an intended timing.

Next, in a state where the driving shaft 13 is inserted into the cam tube 12, the rear end 14 is attached so as to complete the assembling of the camshaft 10 (S60). The camshaft 10 assembled in such a manner is mounted on the engine 20 by connecting one end portion of the driving shaft 13 to the power transmission device 33 and aligns the groove part 35 and the actuator 36.

According to the manufacturing method described above, one cam tube 12 configuring the camshaft 10 extending over three or more cylinders 21 is formed by assembling the plurality of separate tubular members 40 with each other, so that an axial length of each tubular member 40 can be shortened. Therefore, the female spline 45 can be formed by broaching machining on the inner tubular surface 44 of at least the members of the plurality of tubular members 40 which includes the cam members 41 and the cam member 42. That is, the plurality of female splines 45 can be partially formed in the axial direction of the cam tube 12 on the inner tubular surface 44 of the cam tube 12 which is formed by integrating end portions of the tubular members 40 with each other by press-fitting.

As a result, in a state where the driving shaft 13 is inserted into the cam tube 12, the plurality of female splines 45 formed in the cam tube 12 and the male spline 47 formed on the driving shaft 13 are fitted to each other, so that a driving torque for opening and closing the intake or exhaust valve 22 can be sufficiently transmitted from the driving shaft 13.

Further, according to the above manufacturing method, the camshaft 10 can sufficiently transmit the driving torque for opening and closing the intake or exhaust valve 22 without reducing the biasing force of the valve spring 31 of the intake or exhaust valve 22. In addition, it is also not necessary to increase the spline nominal diameter R1 or to provide a plurality of cam tubes 12.

Therefore, since it becomes possible to open and close the intake or exhaust valve 22 accurately at a predetermined timing, while ensuring reliability of the engine 20, the cam tube 12 or the valve mechanism 30 incorporating the camshaft 10 is prevented from becoming heavy and huge so that mountability thereof can be improved. Further, since the female spline 45 is formed by broaching machining, a large-scale device is not necessary as in the electric discharge machining. Therefore, manufacturing cost can be kept low and mass productivity is improved.

FIGS. 7A and 7B illustrate other embodiments of the cam tube 12.

In addition to the above-described embodiment, FIG. 7A illustrates a cam tube 12 in which a female spline 45 is also formed on an inner tubular surface 44 of a journal member 43 (a tubular member without a cam part). However, the journal member 43 is not subject to phase restriction since a cam part 11 is not provided thereon. Therefore, it may not be necessary to provide the female spline 45 in the journal member 43.

In addition to the above-described embodiments, FIG. 7B illustrates a cam tube 12 which does not include a journal member 43, and includes a cam member 41 which includes two cam parts 11 corresponding to intake or exhaust valves 22 of a first cylinder #1 and press-fit projections 48*b*, and a cam member 42 which includes four cam parts 11 corresponding to intake or exhaust valves 22 of a second cylinder #2 and a third cylinder #3. In this manner, in the cam tube 12 of a camshaft 10 extending over three cylinders 21, the cam member 41 and the cam member 42 may be connected to each other. In this case, a number of female splines 45 is smaller than that in the above embodiment.

As described above, a division number of the cam tube 12 and a number of the female splines 45 are flexible, and can be changed in consideration of a specification of the engine 20, the manufacturing cost or the like.

The present application is based on Japanese Patent Application No. 2016-014405 filed on Jan. 28, 2016, contents of which are incorporated herein as reference.

INDUSTRIAL APPLICABILITY

According to the present invention, since it becomes possible to open and close the intake or exhaust valves accurately at a predetermined timing, while ensuring reliability of the engine, the valve mechanism can be prevented from becoming heavy and huge so that the mountability can be improved, manufacturing cost can be kept low, and mass productivity can be improved. The present invention is useful for a camshaft and a manufacturing method therefor.

REFERENCE SIGNS LIST

10 camshaft
11 cam part
12 cam tube
13 driving shaft
40 tubular member
41, 42 cam member (tubular member having a cam part)
43 journal member (tubular member without a cam part)
44 inner tubular surface
45 female spline
46 outer tubular surface
45 male spline

The invention claimed is:

1. A camshaft extending over three or more cylinders arranged in series in an engine, the camshaft comprising:

a plurality of cam parts, each of the plurality of cam parts having a plurality of cam profiles having different shapes with respect to one intake or exhaust valve;

one tubular cam tube on which the plurality of cam parts is arranged to be spaced apart from the each of the plurality of cam parts in an axial direction of the tubular cam tube; and one driving shaft inserted into the cam tube, wherein the tubular cam tube is configured by connecting together a plurality of tubular members, wherein particular ones of the plurality of tubular members are tubular cam members including the plurality of cam parts, wherein the tubular cam members are separated for each of the cylinders, wherein a female spline is arranged on an inner tubular surface of at least each tubular member which includes the tubular cam member among the plurality of tubular members, a plurality of the female splines are partially arranged in the axial direction of the tubular cam tube on an inner tubular surface of the tubular cam tube, and at least one of the plurality of female splines are formed with respect to one of the cylinders, wherein a male spline is arranged on an outer tubular surface of the driving shaft, and wherein, in a state where the driving shaft is inserted into the tubular cam tube, the plurality of female splines and the male spline are mechanically coupled to each other so that the tubular cam tube is configured to rotate integrally with the driving shaft and be movable in an axial direction thereof.

2. The camshaft according to claim 1, wherein the female spline is formed at least on a range between the plurality of cam parts in the axial direction of the driving shaft.

3. The camshaft according to claim 1, wherein the tubular cam tube includes at least one female spline with respect to one cylinder.

4. The camshaft according to claim 1, wherein the male spline is mechanically coupled to the plurality of female splines by contacting an inner tubular surface of each of the plurality of female splines.

5. A manufacturing method for manufacturing a camshaft extending over three or more cylinders arranged in series in an engine, the method comprising:

a step of separately forming a driving shaft and a plurality of tubular members, wherein particular ones of the plurality of tubular members are tubular cam members including a cam part and form a cam tube when being integrated;

a step of forming a male spline on an outer tubular surface of the driving shaft;

a step of forming a female spline by performing broaching machining on an inner tubular surface of at least each tubular member which includes the tubular cam member among the plurality of tubular members; and a step of connecting and integrating all of the plurality of tubular members to form the cam tube, wherein the step of forming the cam tube is a step in which, in a state where the driving shaft is inserted into adjacent tubular members, end potions of the adjacent tubular members are integrated with each other by press-fitting while fitting the male spline with the female spline.

6. The manufacturing method for manufacturing the camshaft according to claim 5, wherein in the step of forming the cam tube, when the tubular members are press-fitted, the driving shaft is fixed and a load in a direction opposite to a rotation direction of the driving shaft when being rotated as the camshaft is applied to the tubular member so as to perform the press-fitting.

7. The manufacturing method for manufacturing the camshaft according to claim 5, further comprising:

a step of forming a plurality of cam profiles having different shapes from each other with respect to one intake or exhaust valve to the cam part after the step of forming the cam tube.

* * * * *